US005682687A

United States Patent [19]

Arai

[11] Patent Number: 5,682,687

[45] Date of Patent: Nov. 4, 1997

[54] SIZE ADJUSTABLE SHOES

[76] Inventor: Kazuyuki Arai, c/o Dong-Iljapan Co., Ltd, Kuriyama Bldg. 2F, 15-4 Kotobashi 4-chome, Sumida-ku, Tokyo, Japan

[21] Appl. No.: 448,103

[22] Filed: May 23, 1995

[30] Foreign Application Priority Data

Feb. 17, 1995 [JP] Japan ..... 7-1742

[51] Int. Cl.[6] ..... A43B 3/26; A43B 3/28

[52] U.S. Cl. ..... 36/97; 36/112

[58] Field of Search ..... 36/8.2, 112, 97, 36/10, 100, 101

[56] References Cited

U.S. PATENT DOCUMENTS

| | | | |
|---|---|---|---|
| 2,523,449 | 9/1950 | Rosenzweg | 36/97 |
| 2,745,196 | 5/1956 | Schneider et al. | 36/97 |
| 2,952,925 | 9/1960 | Held | 36/97 |
| 3,997,985 | 12/1976 | Shiina | 36/97 |
| 4,120,103 | 10/1978 | Colby | 36/97 |
| 4,136,468 | 1/1979 | Munschy | 36/97 |
| 4,944,099 | 7/1990 | Davis | 36/97 |
| 5,570,523 | 11/1996 | Lin | 36/112 |

FOREIGN PATENT DOCUMENTS

| | | | |
|---|---|---|---|
| 174665 | 8/1905 | Germany | 36/97 |
| 465968 | 5/1937 | United Kingdom | 36/97 |

*Primary Examiner*—B. Dayoan

*Attorney, Agent, or Firm*—Knobbe, Martens, Olson & Bear, LLP

[57] ABSTRACT

Stretchable shoes capable of being fixed without causing any stretch of the shoes once adjustment of a size thereof depending on a wearer is completed. Velcro-type hook and loop fasteners are arranged on a heel, so that a size of the shoes may be kept fixed once adjustment of the size is carried out, because engagement between the fasteners exhibits rigidity to a degree sufficient to substantially prevent release of the engagement. Also, the stretchable shoes permit adjustment of a size of the shoes to be readily accomplished by merely loosening a single countersunk screw kept tightened.

3 Claims, 11 Drawing Sheets

SIZE ADJUSTABLE SHOES

BACKGROUND OF THE INVENTION

This invention relates to stretchable shoes, and more particularly to shoes which are adapted to stretch or contract so as to conform to a size of feet of infants, children or the like and vary in size depending on growth of infants and children.

Stretchable shoes have been conventionally known in the art. The conventional stretchable shoes are made of leather. The leather stretchable shoes are required to exhibit increased strength, resulting in a structure of the shoes being complicated and manufacturing of the shoes taking much time and labor. Also, the conventional stretchable shoes require components therefor to exhibit sufficient strength, so that selection of material for the components may be substantially subject to restriction. Thus, the conventional stretchable shoes are caused to be increased in manufacturing cost. A reduction in cost leads to a deterioration in stretchability of the shoes.

SUMMARY OF THE INVENTION

The present invention has been made in view of the foregoing disadvantage of the prior art.

Accordingly, it is an object of the present invention to provide stretchable shoes which are capable of being highly simplified in structure to a degree sufficient to accomplish time and labor savings in the manufacturing.

It is another object of the present invention to provide stretchable shoes which are capable of permitting a material therefor to be substantially unrestrictedly selected.

It is a further object of the present invention to provide stretchable shoes which are capable of being reduced in manufacturing cost.

It is still another object of the present invention to provide stretchable shoes which are comfortable to wear.

It is yet another object of the present invention to provide stretchable shoes which are capable of being fixed without causing any stretch of the shoes once adjustment of a size thereof depending on a wearer is completed.

In accordance with the present invention, stretchable shoes are provided. The stretchable shoes include a shoe body divided into a front section and a rear section. The front section includes a front sole and a front inner sole each of which is formed so as to rearwardly extend by a predetermined length in a tongue-like manner and the rear section includes a rear sole which is provided on a lower surface thereof with a heel having a front edge. The rear sole of the rear section is provided on a portion of an upper surface thereof corresponding to the heel with a first velvet-type fastener and formed with an elongate guide hole elongatedly extending in a longitudinal direction thereof. The front sole of the front section is inserted at a rear portion thereof through the front edge of the heel into an inside of the heel and mounted thereon with a pin so as to vertically extend therefrom. The pin is fitted in the elongate guide hole of the rear sole of the rear section to join the rear section and front section to each other, resulting in providing the shoe body. The front inner sole has a second velvet-type fastener mounted on a lower surface of a rear end thereof, which second velvet-type fastener is detachably engaged with the first velvet-type fastener mounted on the upper surface of the rear sole of the rear section to unite the front section and rear section to each other.

In a preferred embodiment of the present invention, the rear section of the shoe body is detachably provided on each of both outer side surfaces of a front end thereof with a third velvet-type fastener and the front section of the shoe body is detachably provided on each of both inner side surfaces of a rear end thereof with a fourth velvet-type fastener, wherein the third velvet-type fasteners and fourth velvet-type fasteners are detachably engaged with each other.

In a preferred embodiment of the present invention, the heel of the rear sole of the rear section is mounted thereon with a non-slip rubber member.

Also, in accordance with the present invention, stretchable shoes are provided. The stretchable shoes include a shoe body divided into a front section and a rear section. The front section includes a front sole which is formed so as to rearwardly extend by a predetermined length and provided at a rear end thereof with two plug-in connectors and a front inner sole formed so as to rearwardly extend by a predetermined length. The rear section includes a rear sole formed with an elongate hole and a heel which is formed on an upper surface thereof with a guide recess for fitting a rear end of the front sole therein and tightening recesses for fitting the plug-in connectors therein. The tightening recesses are arranged at a rear end of the guide recess in a manner to be contiguous to the guide recess. The front sole of the front section is formed with a fit hole. The stretchable shoes also include an interposed member formed therein with a threaded hole and securely fitted in the fit hole of the front sole. The front inner sole of the front section is formed with a hole in a manner to correspond to the threaded hole of the interposed member of the front sole. The front sole of the front section is inserted at a rear end thereof into the guide recess and tightening recesses of the heel of the rear section and the front inner sole of the front section is inserted into an upper side of the rear sole while interposing the rear sole of the rear section therebetween. The stretchable shoes further include a countersunk screw inserted through the hole of the front inner sole and the elongate hole of the rear sole and securely threadedly fitted in the threaded hole of the interposed member of the front sole to unite the front section and rear section to each other.

In a preferred embodiment of the present invention, the front inner sole of the front section of the shoe body is provided on a lower surface thereof with a first velvet-type fastener and correspondingly the rear sole of the rear section of the shoe body is provided on an upper surface thereof with a second velvet-type fastener so as to be detachably engaged with the first fastener.

Further, in accordance with the present invention, stretchable shoes are provided. The stretchable shoes include a shoe body divided into a front section and a rear section. The front section includes a front sole which is formed so as to rearwardly extend in a tongue-like manner and provided at a rear end thereof with two plug-in connectors. The rear section includes a rear sole and a heel. The heel is formed on an upper surface thereof with a guide recess for fitting a rear end of the front sole therein and tightening recesses for fitting the plug-in connectors therein and provided at a portion thereof extending over the guide groove and tightening grooves with a recessed space. The stretchable shoes also include an interposed member received in the recessed space and provided on a central portion of an upper surface thereof with a projection. The projection is formed into a predetermined height and formed therein with a threaded hole so as to vertically extend in an axial direction thereof for threadedly fitting a countersunk screw therein. The interposed member is formed on each of portions of the upper surface thereof between which the projection is interposed with an engagement pressedly engaged with each of the plug-in connectors of the front sole of the front section of the shoe body. The rear sole of the rear section is formed at a portion thereof abutted against a top surface of the projection with a small hole. The countersunk screw is threadedly inserted through the small hole of the rear sole into the threaded hole of the interposed member.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
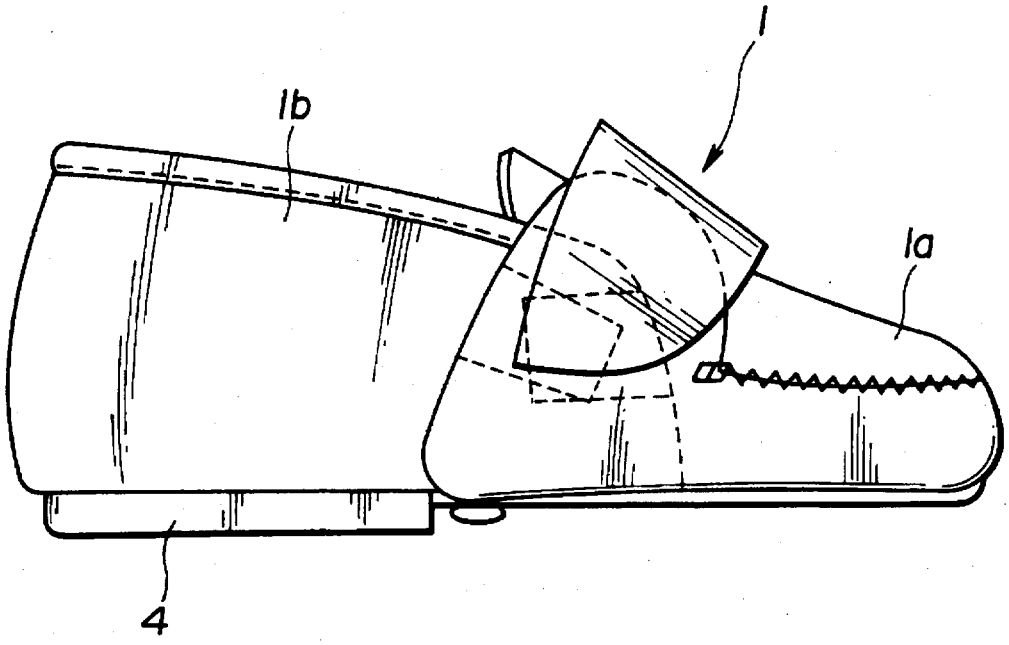
FIG. 1 is a side elevation view generally showing a first embodiment of stretchable shoes according to the present invention.
Figure 2:
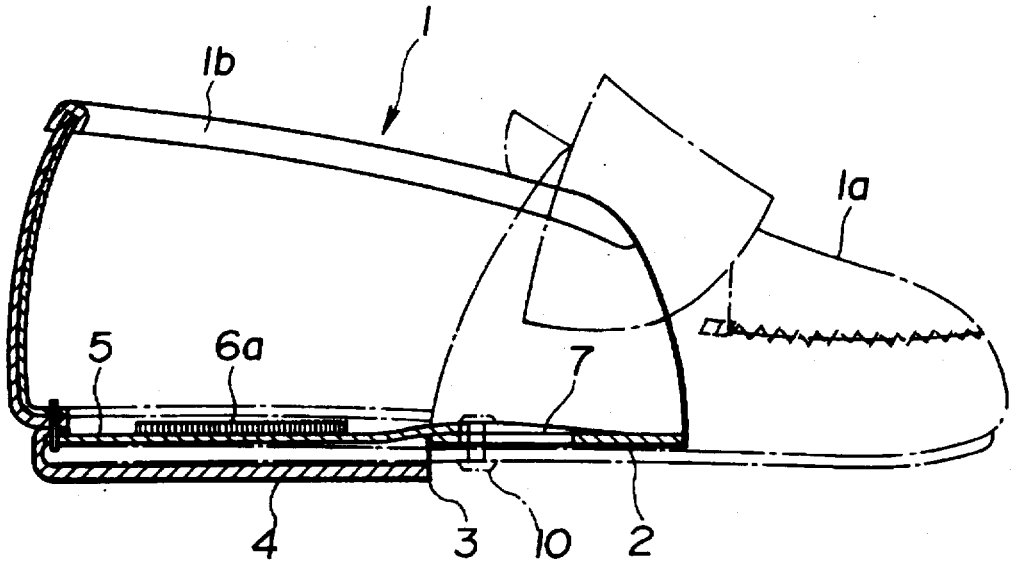
FIG. 2 is a side elevation view partly in section of the stretchable shoes shown in FIG. 1.
Figure 3:
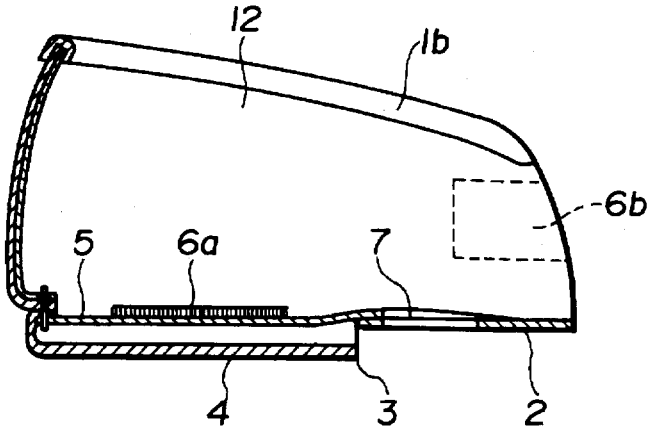
FIG. 3 is a vertical sectional side elevation view showing a rear section of the stretchable shoes of FIG. 1.
Figure 4:
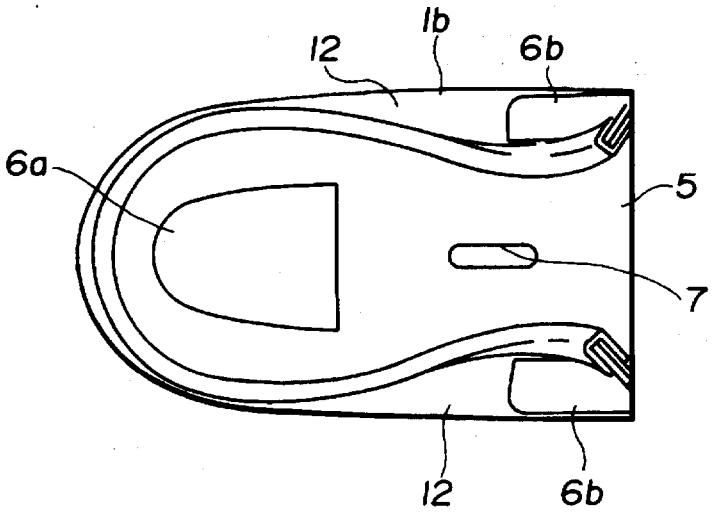
FIG. 4 is a plan view of the rear section of the stretchable shoes shown in FIG. 3.
Figure 5:
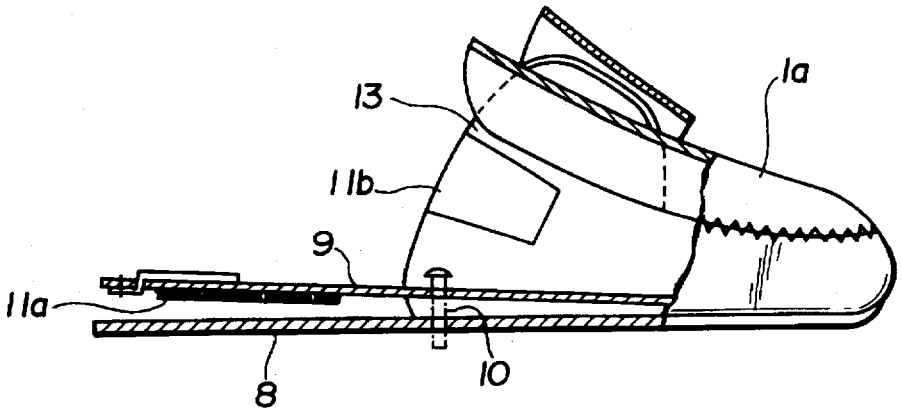
FIG. 5 is a partially cutaway side elevation view in section showing a front section of the stretchable shoes of FIG. 1.
Figure 6:
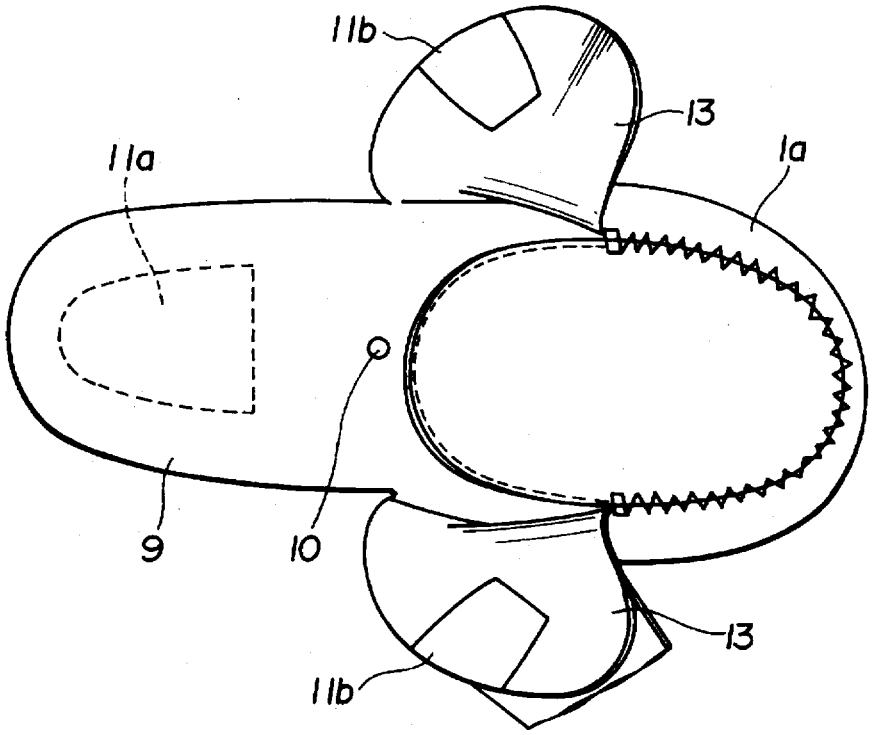
FIG. 6 is an expanded plan view of the front section of the stretchable shoes shown in FIG. 5 wherein velvet-type fasteners arranged on both sides thereof are outwardly expanded.
Figure 7:
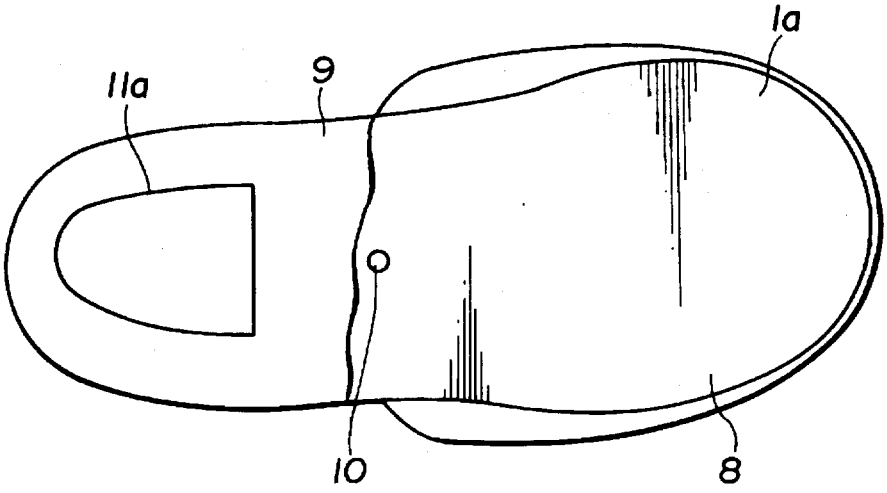
FIG. 7 is a partially cutaway bottom view showing a velvet-type fastener arranged on a front inner sole of the front half of the stretchable shoes of FIG. 6.

Now, stretchable shoes according to the present invention will be described hereinafter with reference to the accompanying drawings.

Referring first to FIGS. 1 to 8, a first embodiment of stretchable shoes according to the present invention is illustrated. Stretchable shoes of the first embodiment include a shoe body 1 divided into a front section 1*a* and a rear section 1*b*. The rear section 1*b* includes a rear sole 2 which is provided on a lower surface thereof with a heel 4 having a front edge 3. Also, the rear sole 2 has a rear member 5 adhesively mounted on an upper surface thereof in a manner to positionally correspond to the heel 4. The rear member 5 is provided thereon with a first VELCRO-type hook and loop fastener 6*a*. The rear member 5 and rear sole 2 are formed at a center of a portion thereof superposed on each other with a common elongate guide hole 7 vertically extending therethrough and elongatedly extending in a longitudinal direction thereof. The front section 1*a* includes a front sole 8 and a front inner sole 9 each of which is formed so as to rearwardly extend by a predetermined length in a tongue-like manner. The front sole 8 is inserted at a rear portion thereof through the front edge 3 of the heel 4 into an inside of the heel 4. The front sole 8 is mounted thereon with a pin 10 so as to vertically extend therefrom, which pin is then fitted into the guide through-hole 7 of the rear section 1*b* to join the rear section 1*b* and front section 1*a* to each other, resulting in providing the shoe body 1. The front inner sole 9 has a second VELCRO-type hook and loop fastener 11*a* adhesively mounted on a lower surface of a rear end thereof. The second VELCRO-type hook and loop fastener 11*a* is detachably engaged with the first VELCRO-type hook and loop fastener 6*a* mounted on the upper surface of the rear member 5 of the rear sole 2 to unite the front section 1*a* and rear section 1*b* to each other. The rear sole 2 and rear member 5 may be made of the same material.

Also, the rear section 1*b* of the shoe body 1 is provided on each of both outer side surfaces 12 of a front end thereof with a third VELCRO-type fastener 6*b* in a detachable manner and the front section 1*a* of the shoe body 1 is detachably provided on each of both inner side surfaces 13 of a rear end thereof with a fourth VELCRO-type fasteners 11*b*. Thus, the second VELCRO-type fastener 11*a* provided on the lower surface of the rear end of the front inner sole 9 is releasably or detachably engaged with the first VELCRO-type fastener 6*a* provided on the upper surface of the rear member of the rear section 1*b* as described above and the third VELCRO-type fasteners 6*b* on the outer side surfaces of the rear section 1*b* are detachably engaged with the fourth VELCRO-type fasteners 11*b* provided on the inner side surfaces of the front section 1*a*.

Figure 8:
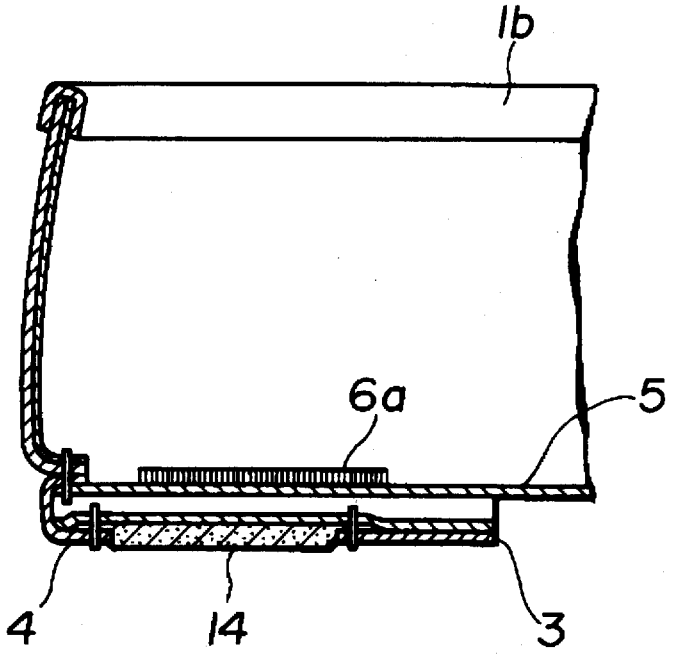
FIG. 8 is a fragmentary vertical sectional side elevation view showing a heel of a rear half of the stretchable shoes of FIG. 1 which is provided thereon with a non-slip rubber sole.

The heel 4 of the rear sole 2 of the rear section 1*b* may be mounted thereon with a non-slip rubber member 14 as shown in FIG. 8. The mounting may be carried out by sewing or any other suitable means such as welding, adhesion or the like.

Referring now to FIGS. 9 to 13, a second embodiment of stretchable shoes according to the present invention is illustrated.

Stretchable shoes of the second embodiment include a shoe body 15 likewise divided into a front section 15*a* and a rear section 15*b*. The front section 15*a* includes a front sole 16 which is formed so as to rearwardly extend in a tongue-like manner. The front sole 16 is provided at a rear end thereof with two plug-in connectors 17 of a predetermined length in a manner to be laterally parallel to each other or spaced from each other at a predetermined interval. The front section 15*a* also includes a front inner sole 18 formed so as to rearwardly extend in a tongue-like manner.

The rear section 15*b* includes a heel 19 which may be made of rigid synthetic rubber. The heel 19 is formed on a front portion of an upper surface thereof with a guide recess or groove 20, which is formed into a depth substantially equal to a thickness of the front sole 16 so that the rear end of the front sole 16 may be fitted in the guide recess 20. For this purpose, the heel 19 is also provided with a pair of tightening recesses 21 in a manner to be contiguous to the guide recess 20 and outwardly extend therefrom. The tightening recesses 21 are formed in conformity to the plug-in connectors 17 of the front sole 16, resulting in being adapted to receive the connectors 17 therein, respectively. Thus, the tightening recesses 21 are arranged at the rear end of the guide recess 20 in a manner to be contiguous to the guide recess 20.

The front section 15*a* also includes an interposed member 22, which is fixedly fitted in a fit hole 23 formed in the front sole 16. The interposed member 22 is formed therein with a threaded hole 24 so as to vertically extend in an axial direction thereof, in which a countersunk screw 25 is threadedly fitted. Likewise, the front inner sole 18 is formed with a hole 26 through which the screw 25 is inserted.

The rear section 15*b* includes a rear sole 27, which is formed at a predetermined position thereof with an elongate hole 28 through which the countersunk screw 25 is inserted. The rear sole 27 of the rear section 15*b* is connected at a rear end thereof to a lower end 29 of a rear wall of the rear section 15*b* in a manner to be integral therewith. Alternatively, the rear sole 27 and rear wall may be made of different materials, respectively, resulting in being joined to each other in a manner to wind on each other.

The second embodiment may be constructed in such a manner that the front inner sole 18 of the front section 15*a* of the shoe body 15 is provided on a lower surface thereof with a first VELCRO-type fastener 30*a* and correspondingly the rear sole 27 of the rear section 15*b* of the shoe body 15 is provided on an upper surface thereof with a second VELCRO-type fastener 30*b* so as to be detachably engaged with the first fastener 30*a*.

Referring now to FIGS. 14 to 20, a third embodiment of stretchable shoes according to the present invention is illustrated. Stretchable shoes of the third embodiment include a shoe body 31 likewise divided into a front section 31*a* and a rear section 31*b*. The front section 31*a* of the shoe body 31 includes a front sole 32, which is formed so as to rearwardly extend in a tongue-like manner and has two plug-in connectors 33 formed at a rear end thereof into a predetermined length and in a manner to be spaced from each other in parallel at a predetermined interval as in the second embodiment described above.

The rear section 31*a* includes a heel 34, which may be made of rigid synthetic rubber. The heel 34 is provided on a front portion of an upper surface thereof with a guide recess 35. The guide recess 35 is formed into a depth substantially equal to a thickness of the front sole 32 so as to permit a rear end of the front sole 32 to be fitted therein. The heel 34 is also provided with tightening recesses 36 in conformity to the plug-in connectors 33. Thus, the tightening recesses 36 are formed in a manner to be contiguous to the guide recess 35 and rearwardly extend therefrom. The heel 34 is further provided at a portion thereof extending over the guide groove 35 and tightening grooves 36 with a recesses space 37.

The recessed space 37 is adapted to receive an interposed member 38 therein. The interposed member 38 is made of a metal material and provided on a central portion of an upper surface thereof with a projection 39, which is formed into a height substantially flush with an upper surface of the heel 34. The projection 39 is formed therein with a threaded hole 40 so as to vertically extend in an axial direction thereof, in which a countersunk screw 41 is threadedly fitted. The interposed member 38 is also formed on each of portions of the upper surface thereof between which the projection 39 is interposed with an engagement 42 pressedly engaged with each of the plug-in connectors 33 of the front sole 32 of the front section 31*a* of the shoe body 31.

The rear section 31*b* of the shoe body 31 has a rear sole 43 mounted thereon, which is formed at a predetermined position thereof with a small hole 44 through which the countersunk screw 41 is inserted. The rear sole 43 is integrally superposedly mounted on a lower surface thereof with a rigid fiber member 45, for example, by adhesion or the like so as to reinforce the rear sole 43. The rear sole 43 is connected to a lower end 46 of a rear wall of the rear section 31*b*, for example, by winding.

Now, the manner of operation of the stretchable shoes of each of the first to third embodiments described above will be described hereinafter.

When the stretchable shoes of the first embodiment are small in size for an infant or a child, the second VELCRO-type fastener 11*a* of the front inner sole 9 is released or disengaged from the first VELCRO-type fastener 6*a* of the rear member 5 of the rear sole 2 to move the front section 1*a* or rear section 1*b* of the shoe body 1 along the pin 10 fitted in the elongate guide hole 7 to extend or stretch the shoe body 1. On the contrary, when the shoes are too large therefor, the front section 1*a* and rear section 1*b* are moved relative to each other to cause to approach each other, to thereby contract the shoes. Thus, the shoe body 1 of the shoes can be retractably adjusted in size as desired depending on a size of feet of a wearer. Once a size of the shoes are thus determined, the VELCRO-type fasteners 6*a* and 11*a* are securely engaged with each other to fix a size of the shoe body 1, to thereby permit the shoes to exhibit well-fitness.

Figure 9:
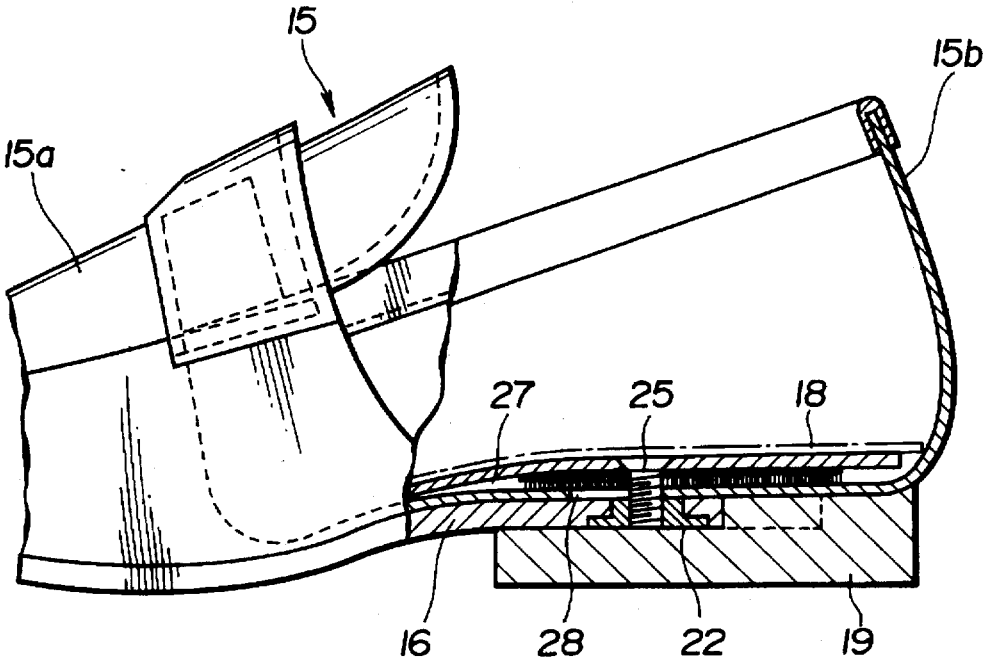
FIG. 9 is a fragmentary side elevation view partly in section showing a rear portion of a second embodiment of stretchable shoes according to the present invention.
Figure 10:
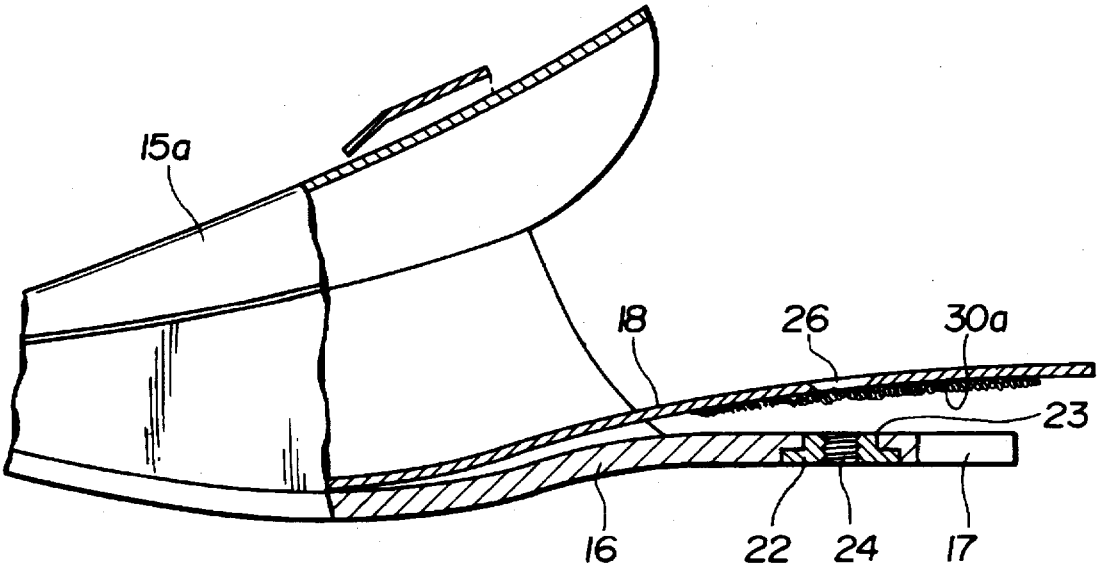
FIG. 10 is a fragmentary partially cutaway vertical sectional side elevation view of the rear section of the stretchable shoes shown in FIG. 9.
Figure 11:
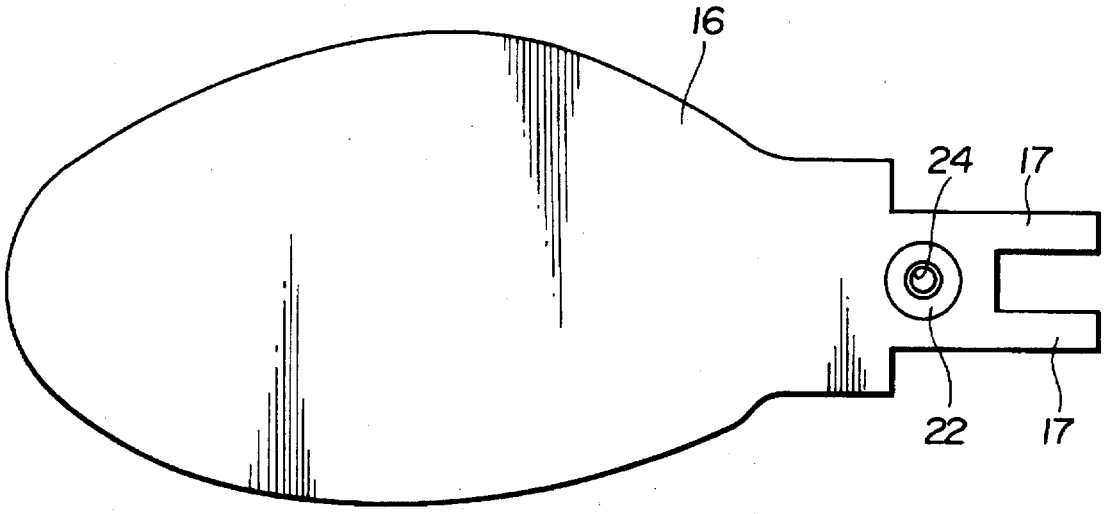
FIG. 11 is a plan view showing a plan view showing a sole element of the front section of the stretchable shoes shown in FIG. 10.
Figure 12:
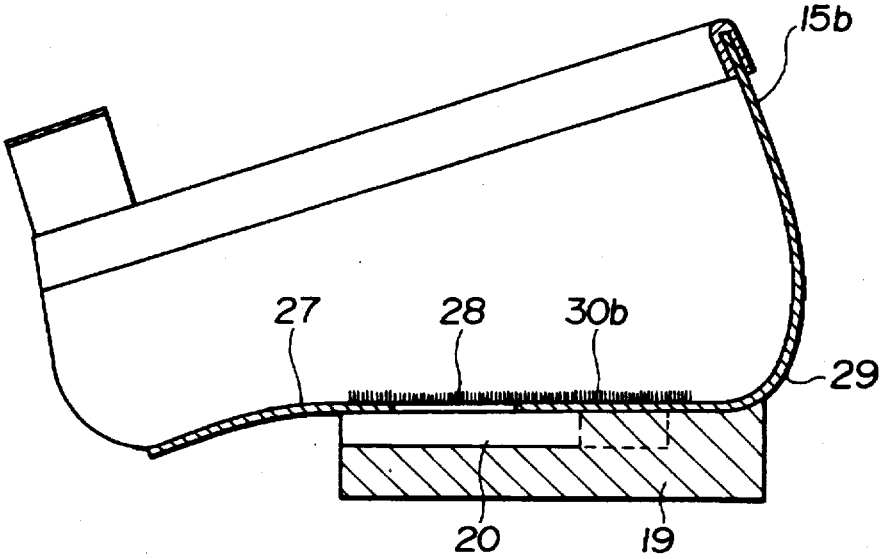
FIG. 12 is a sectional view showing a rear section of the stretchable shoes of FIG. 10.
Figure 13:
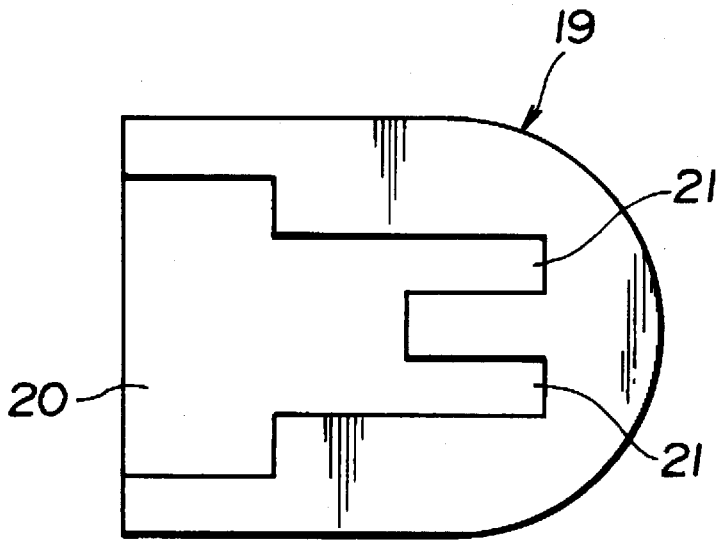
FIG. 13 is a plan view showing a heel element of the rear section of the stretchable shoes of FIG. 10.

Also, in the stretchable shoes of the second embodiment constructed as described above, when the rear sole 27 of the rear section 15*b* of the shoe body 15 is superposed on the heel 19 to unite the rear sole 27 and heel 19 to each other by a suitable means such as nails, an adhesive or the like, the guide recess 20 and tightening grooves 21 are formed between the rear sole 27 and the upper surface of the heel 19. Then, when the rear end of the front sole 16 is fitted in the guide groove 20, the plug-in connectors 17 are fitted in the tightening recesses 21 as shown in FIG. 9 and concurrently the rear end of the front sole 16 contiguous to the plug-in connectors 17 is fitted in the guide recess 20. Thereafter, when the countersunk screw 22 is threadedly inserted through the small hole 26 of the front sole 18 into the interposed member 22 fixedly fitted in the front sole 16 and tightened, the rear sole 27 is firmly interposed between the front inner sole 18 and the front sole 16, so that the front sole 16, front inner sole 18, heel 19 and rear sole 27 may be firmly integrated with each other, to thereby prevent the front section 15*a* and rear section 15*b* of the shoe body 15 from separated or released from each other.

Figure 14:
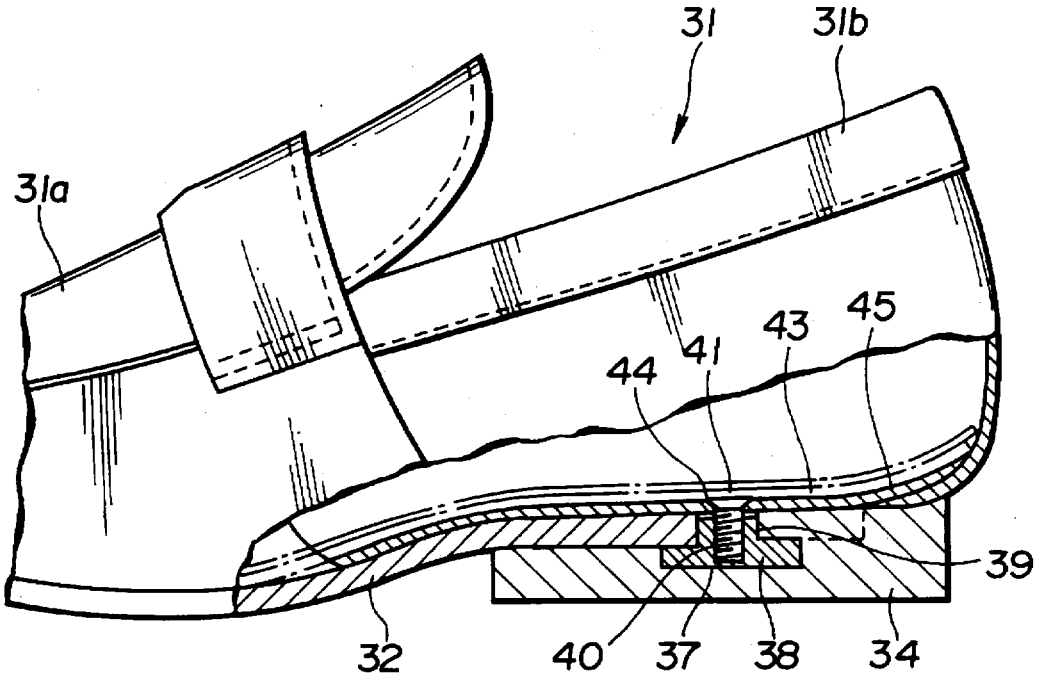
FIG. 14 is a fragmentary partially cutaway side elevation view partly in section showing a rear section of a third embodiment of stretchable shoes according to the present invention.
Figure 15:
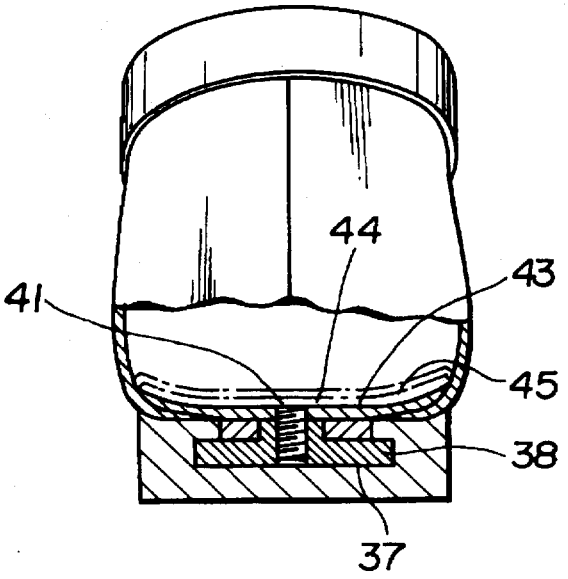
FIG. 15 is a partially cutaway rear elevation view partly in section showing an essential part of the rear section of the stretchable shoes shown in FIG. 14.
Figure 16:
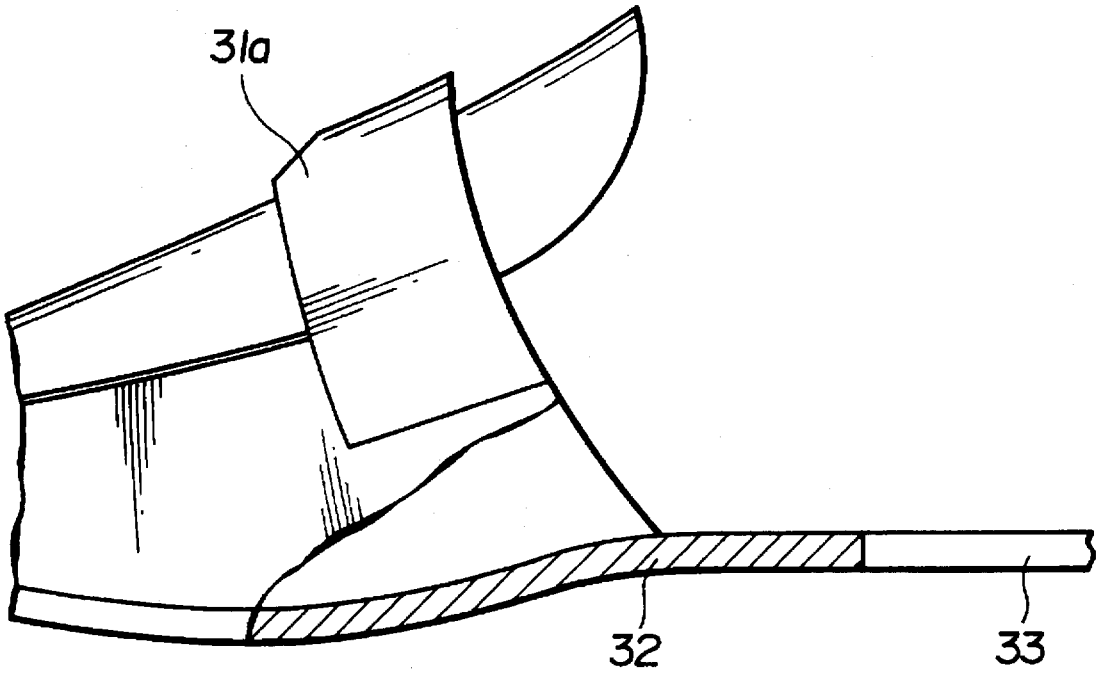
FIG. 16 is a fragmentary side elevation view partly in section showing an essential part of a front section of the stretchable shoes of FIG. 14.
Figure 17:
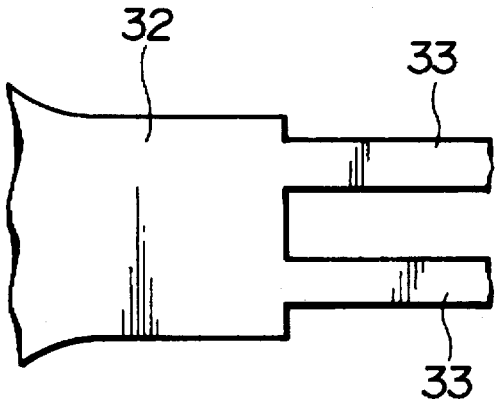
FIG. 17 is a fragmentary schematic plan view showing a front sole element of the front section of the stretchable shoes shown in FIG. 16.
Figure 18:
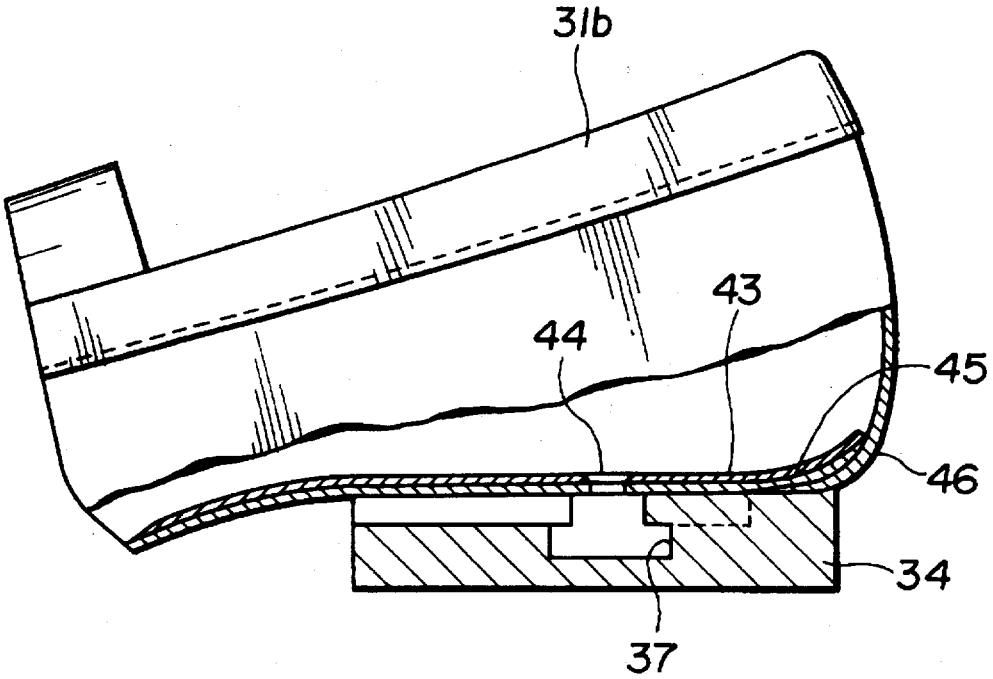
FIG. 18 is a fragmentary partially cutaway side elevation view partly in section showing a rear section of the stretchable shoes of FIG. 14.
Figure 19:
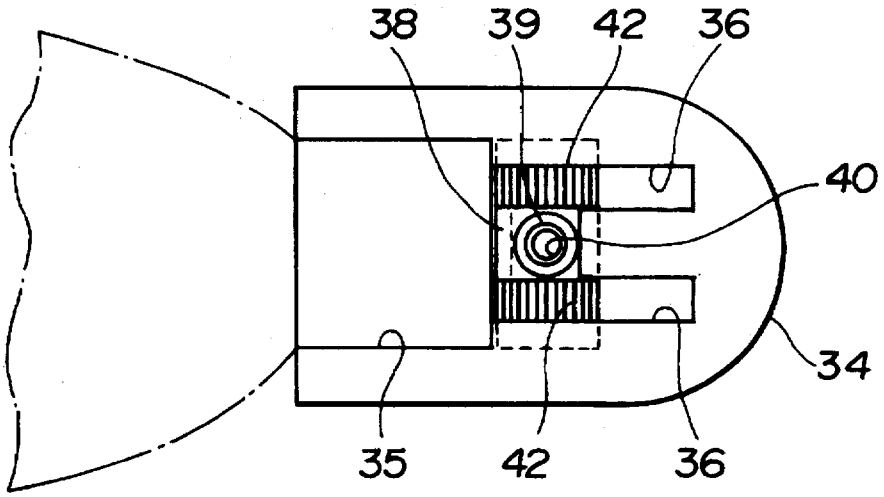
FIG. 19 is a plan view showing a heel which is incorporated in the rear section of the stretchable shoes shown in FIG. 18.
Figure 20:
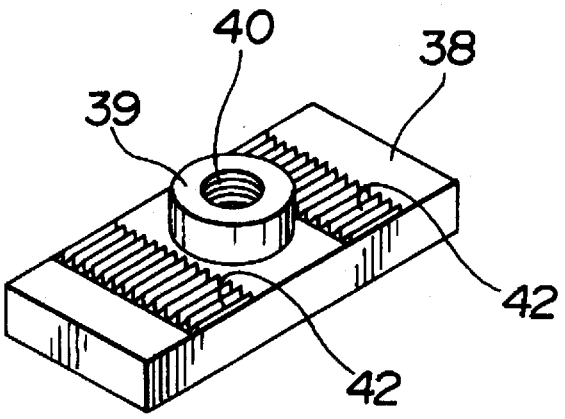
FIG. 20 is a perspective view showing an interposed member incorporated in the heel of the rear section of the stretchable shoes shown in FIG. 19.

In the stretchable shoes of the third embodiment constructed as described above, when the rear sole 43 of the rear section 31*b* of the shoe body 31 is superposed on the upper surface of the heel 43 and then integrally joined to each other by means of nails or an adhesive, the guide recess 35 and tightening recesses 36 are formed between the rear sole 43 and the upper surface of the heel 34. Then, the rear end of the front sole 32 is inserted into the guide groove 35, so that the plug-in connectors 33 may be fitted in the tightening recesses 32 as shown in FIGS. 14, 15 and 19. The interposed member 38 is previously received in the recessed space 37; therefore, when the projection 39 is inserted between the plug-in connectors 33 of the front sole 32 and then the countersunk screw 41 is threadedly fitted through the small hole 44 of the rear sole 43 into the threaded hole 40 of the projection 39 and tightened, the front sole 32 may be securely interposed between the interposed member 38 and the rear sole 43. This results in the front sole 32, heel. 34 and rear sole 43 being firmly integrated with each other, to thereby prevent the front section 31*a* and rear section 31*b* of the shoe body 31 from being unintentionally separated or loosened from each other.

As can be seen from the foregoing, the stretchable shoes of the present invention facilitate stretchable adjustment of the shoes while simplifying a structure thereof and permit a manufacturing cost thereof to be decreased, resulting in being particularly suitable for an infant and a child.

Also, the stretchable shoes of the present invention are so constructed that the VELCRO-type fasteners are arranged on the heel. Such construction permits a size of the shoes to be kept fixed once adjustment of the size is carried out, because engagement between the fasteners exhibits rigidity to a degree sufficient to substantially prevent release of the engagement.

Further, the stretchable shoes of the present invention permit adjustment of a size of the shoes to be readily accomplished by merely loosening the single countersunk screw kept tightened.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A length-adjustable shoe having a shoe body divided into a separable front section and rear section, said shoe body comprising:

said rear section provided with an intermediate sole and a heel portion each having a forward end, in which a lengthwise recession is formed between said intermediate sole and said heel portion and is open at the forward end of said heel portion, said intermediate sole having an elongate guide hole extending in a longitudinal direction;

a first fastener structure, which is one side of a hook-and-loop fastener, fixed on an upper surface of said intermediate sole over said heel portion where the heel will be in place;

said front section provided with an inside sole and an outside sole each having a back end, the back end of said outside sole being inserted into said recession in said rear section, wherein said intermediate sole of said rear section is interposed between said inside sole and said outside sole;

a second fastener structure, which is the other side of said hook-and-loop fastener, fixed on a lower surface of said inside sole where said first fastener structure is positioned to fasten said front section to said rear section by engaging said first fastener structure with said second fastener structure, wherein said first and second fastener structures are securely engaged when the heel is in position; and a pin fixed in said inside sole and said outside sole of said front section through said elongate guide hole of said intermediate sole of said rear section, wherein said front section with said pin is movable along said elongate guide hole.

2. A length-adjustable shoe according to claim 1, wherein each of said rear section and said front section has right and left side portions, wherein the respective side portions overlap, said shoe body further comprising, at each of said right and left side portions:

a third fastener structure, which is one side of a hook-and-loop fastener, fixed on an outside surface of the overlapping side portion of said rear section; and a fourth fastener structure, which is the other side of said hook-and-loop fastener, fixed on an outside surface of the overlapping side portion of said front section, wherein said from section and said rear section are fastened by engaging said third fastener structure with said fourth fastener structure on each side portion.

3. A length-adjustable shoe according to claim 1, further comprising a non-slip rubber member outwardly mounted on said heel portion.

* * * * *